US010109235B2

(12) United States Patent
Xiong et al.

(10) Patent No.: US 10,109,235 B2
(45) Date of Patent: Oct. 23, 2018

(54) COMPENSATION CIRCUIT, AMOLED STRUCTURE AND DISPLAY DEVICE

(71) Applicant: EverDisplay Optronics (Shanghai) Limited, Shanghai (CN)

(72) Inventors: Nana Xiong, Shanghai (CN); Yu-Hsiung Feng, Shanghai (CN); Jiangang Wang, Shanghai (CN)

(73) Assignee: EVERDISPLAY OPTRONICS (SHANGHAI) LIMITED, Shanghai (CN)

( * ) Notice: Subject to any disclaimer, the term of this patent is extended or adjusted under 35 U.S.C. 154(b) by 95 days.

(21) Appl. No.: 15/135,816

(22) Filed: Apr. 22, 2016

(65) Prior Publication Data

US 2016/0314743 A1 Oct. 27, 2016

(30) Foreign Application Priority Data

Apr. 23, 2015 (CN) ..... 2015 1 0197799

(51) Int. Cl.
*G09G 3/3258* (2016.01)
*G09G 3/30* (2006.01)

(52) U.S. Cl.
CPC ..... *G09G 3/3258* (2013.01); *G09G 3/30* (2013.01); *G09G 2300/0426* (2013.01); *G09G 2300/0814* (2013.01); *G09G 2300/0819* (2013.01); *G09G 2300/0842* (2013.01); *G09G 2300/0861* (2013.01); *G09G 2310/0262* (2013.01); *G09G 2310/08* (2013.01)

(58) Field of Classification Search
CPC ..... G09G 3/30–3/3291
See application file for complete search history.

(56) References Cited

U.S. PATENT DOCUMENTS

2006/0124944 A1* 6/2006 Kwak ..... G09G 3/325 257/96
2011/0248906 A1 10/2011 Asano
2014/0291640 A1* 10/2014 Miyake ..... H01L 27/3262 257/40
2015/0325174 A1* 11/2015 Yu ..... G09G 3/3233 345/77

FOREIGN PATENT DOCUMENTS

CN 101493614 A 7/2009
CN 102338957 A 2/2012

* cited by examiner

*Primary Examiner* — Hang Lin
(74) *Attorney, Agent, or Firm* — Andrew F. Young, Esq.; Lackenbach Siegel, LLP

(57) ABSTRACT

The present invention relates to the field of display apparatus, more specifically, to a compensation circuit, an AMOLED structure and a display device. Said circuit comprises a plurality of pixel units, each for the plurality of pixel units includes at least one light emitter, and each of said pixel units comprises: an anode initialization signal interface, a CST initialization port, a data control port and an enable signal control port. Compared with the prior art, the advantages of the present invention are: according to the invention, there is no need to individually set up an anode initialization signal line, the umber of the signal lines are reduced from 4 to 3, which is benefit for achieving the design of the product HPPI. And the signal control lines reduce the space occupied by jumper wire during the connection process, which is benefit to the design of narrow border products.

23 Claims, 3 Drawing Sheets

COMPENSATION CIRCUIT, AMOLED STRUCTURE AND DISPLAY DEVICE

The present application claims priority to and the benefit of Chinese Patent Application No. CN 201510197799.2, filed on Apr. 23, 2015, the entire content of which is incorporated herein by reference.

FIELD OF THE INVENTION

The invention relates to the field of display apparatus, more specifically, to a compensation circuit, an AMOLED structure and a display device.

BACKGROUND OF THE INVENTION

As shown in FIG. 1, the conventional pixel compensation circuit 100 is normally provided with, in addition to a power terminal, four signal control terminals: Storage Capacitance (CST) initialization terminal 105, data input terminal 110, anode initialization terminal 115, and control terminal 120. Such a pixel compensation circuit has four different operating states—they are CST initialization state, data inputting state, anode initialization state, and light-emitting state, respectively. At first, the capacitor is charged when the circuit 100 operates in the CST initialization state. The data input terminal 110 then writes voltage signal when the circuit 100 is in the data inputting state. When the circuit 100 is in the anode initialization state, the circuit 100 eliminates the residual charge of the light emitter to prolong the service life of the light emitter. FIG. 2 shows the AMOLED (Active-matrix organic light emitting diode) 200 that uses the compensation circuit 100 shown in FIG. 1. The AMOLED 200 is not conducive to realize the design of the HPPI (High Pixels Per Inch) product because there is a large amount of data from the control terminal 120, the connections of the terminals are complicated, and the circuitry architecture of the circuit 100 uses more vertical direction circuitry design. In addition, as the control terminal processes too much data, the circuit 100 begins to take up more space during the connection process, which is not conducive to the design of narrow border products.

SUMMARY OF THE INVENTION

For the deficiencies of the prior art, the invention provides a compensation circuit to reduce the number of signal control lines and to optimize the circuit architecture and an AMOLED structure and a display device.

A compensation circuit configured to work with active-matrix organic light emitting diode (AMOLED) devices, the compensation circuits comprising at least a first pixel unit, a second pixel unit, and a third pixel unit, wherein each of the first, second, and third pixel units comprises:

at least one light emitter;

a first switch and a second switch;

an anode initialization signal interface comprising an anode initialization input terminal and an anode initialization output terminal, wherein the anode initialization input terminal of the second pixel unit is formed by the anode initialization output terminal of the first pixel unit, where the anode initialization input terminal of each pixel unit is coupled with an anode of said light emitter of the pixel unit, wherein the compensation circuit is configured to operate in an anode initialization operating state by initializing the anode of the light emitter via the anode initialization input terminal upon detecting a predetermined signal;

a CST initialization terminal, configured to control an state of the first switch, wherein the CST initialization terminal is coupled with a control terminal of the first switch, where an input terminal of said first switch is coupled with a first reference potential terminal of the compensation circuit, wherein an output terminal of the first switch is coupled with a negative terminal of a capacitor, wherein a positive terminal of the capacitor is coupled with a high level of power source, where the compensation circuit is configured to change its operation state to a CST initialization state when the first switch is in a conducting state;

a data control terminal, configured to control the operating state of the second switch, wherein the data control terminal is coupled with a control terminal of the second switch, wherein an input terminal of the second switch is coupled with and inputting terminal of the compensation circuit, and an output terminal of the second switch is coupled with a negative terminal of the capacitor, wherein said capacitor stores signals output from the data inputting terminal when the second switch is in a conducting state, wherein the compensation circuit is configured to operate in a data inputting state when the second switch is in the conducting state;

a signal control terminal configured to output a predetermined signal after the second pixel unit goes through the anode initialization state, the CST initialization state and the data inputting state, to cause the light emitter to operate in a light-emitting state.

In the above compensation circuit, the anode initialization output terminal of the second pixel unit is used to form the anode initialization input terminal of the third pixel unit.

In the above compensation circuit, said first switch comprises a first switch control tube, a second switch control tube and a third switch control tube, wherein a control terminal of the first switch control tube, a control terminal of the second switch control tube, and a control terminal of the third switch control tube are coupled with the CST initialization terminal.

In the above compensation circuit, wherein an output terminal of the first switch control tube is coupled with the negative terminal of the capacitor.

In the above compensation circuit, wherein an input terminal of the first switch control tube is coupled with an output terminal of the second switch control tube.

In the above compensation circuit, wherein an input terminal of the second switch control tube is coupled with an output terminal of the third switch control tube.

In the above compensation circuit, wherein an input terminal of the third switch control tube is coupled with the first reference potential terminal of the compensation circuit.

In the above compensation circuit, wherein the output terminal of the third switch control tube forms the anode initialization output terminal of the compensation circuit.

In the above compensation circuit, wherein said second switch includes a fourth switch control tube, a fifth switch control tube, a sixth switch control tube, a seventh switch control tube and an eighth switch control tube.

In the above compensation circuit, wherein both a control terminal of the fourth switch control tube and a control terminal of the sixth switch control tube is coupled with the data control terminal.

In the above compensation circuit, wherein an input terminal of the fourth switch control tube is coupled with the data inputting terminal.

In the above compensation circuit, wherein an output terminal of the fourth switch control tube is coupled with an input terminal of the fifth switch control tube and an input terminal of the eighth switch control tube.

In the above compensation circuit, wherein an output terminal of the fifth switch control tube is coupled with the high level of voltage source.

In the above compensation circuit, wherein a control terminal of the seventh switch control tube and a control terminal of the fifth switch control tube are coupled with the signal control terminal.

In the above compensation circuit, wherein an input terminal of the seventh switch control tube is coupled with an output terminal of an eighth switch control tube and an input terminal of the sixth switch control tube.

In the above compensation circuit, wherein an output terminal of the seventh switch control tube is coupled with the anode of the light emitter, and wherein a control terminal of the eighth switch control tube is coupled with an output terminal of the sixth switch control tube and the negative terminal of the capacitor.

In the above compensation circuit, said first switch is a PMOS transistor.

In the above compensation circuit, said second switch is a PMOS transistor.

In the above compensation circuit, said predetermined signal has a low voltage level.

An AMOLED structure, comprising a pixel array having a plurality of pixel units arranged in an array comprising rows and columns;

each of said pixel units comprises a CST initialization signal line, a data inputting signal line, an enabling signal line and an anode initialization signal line;

wherein the anode initialization signal lines of the pixel units of an N-th row are coupled with the input ends of the CST initialization signal lines of the pixel units of the N+1-th row, wherein said N is a positive integer.

In the above AMOLED structure, each of the pixel units is configured on said AMOLED structure in a vertical manner.

A display device, comprising an AMOLED structure having:

a pixel array comprising a plurality of pixel units arranged in an array having rows and columns;

wherein each of said pixel units are provided with CST initialization signal line, a data inputting signal line, an enabling signal line and an anode initialization signal line;

wherein the anode initialization signal lines of the pixel units of an N-th row are coupled with the input ends of the CST initialization signal lines of the pixel units of the N+1-th row, said N is a positive integer.

In the above display device, each of the pixel units is disposed within said AMOLED structure in a vertical manner.

Compared with the prior art, the advantages of the present invention are:

according to the invention, there is no need to individually set up an anode initialization signal line, the umber of the signal lines are reduced from 4 to 3, which is benefit for achieving the design of the product HPPI. And the signal control lines reduce the space occupied by jumper wire during the connection process, which is benefit to the design of narrow border products. The invention also changes the order of the four operating statuses of the compensation circuit, which are in order the anode initialization state, the CST initialization state, the data written state and the light-emitting state.

BRIEF DESCRIPTION OF THE DRAWINGS

The accompanying drawings, together with the specification, illustrate exemplary embodiments of the present disclosure, and, together with the description, serve to explain the principles of the present invention.

DETAILED DESCRIPTION

Figure 1:
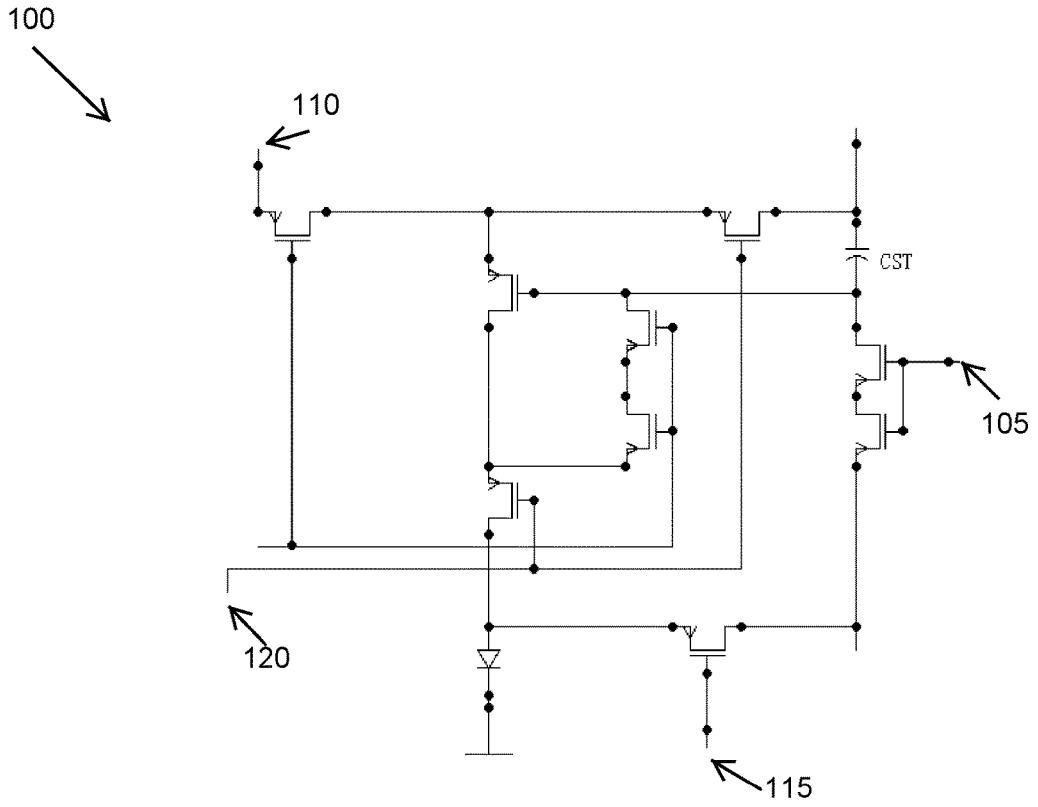
FIG. 1 is a connection diagram of a conventional compensation circuit.
Figure 2:
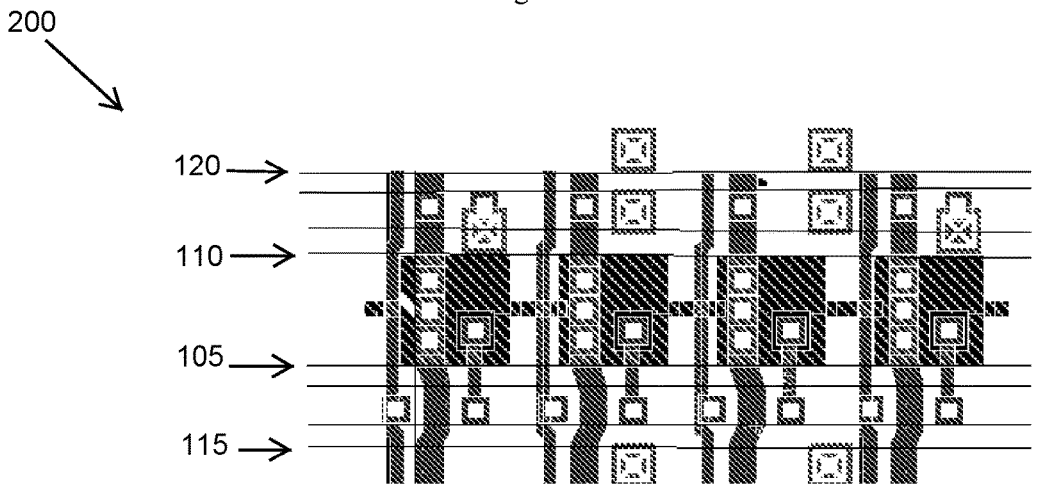
FIG. 2 is a schematic of the circuit architecture of a conventional AMOLED structure.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

Figure 3:
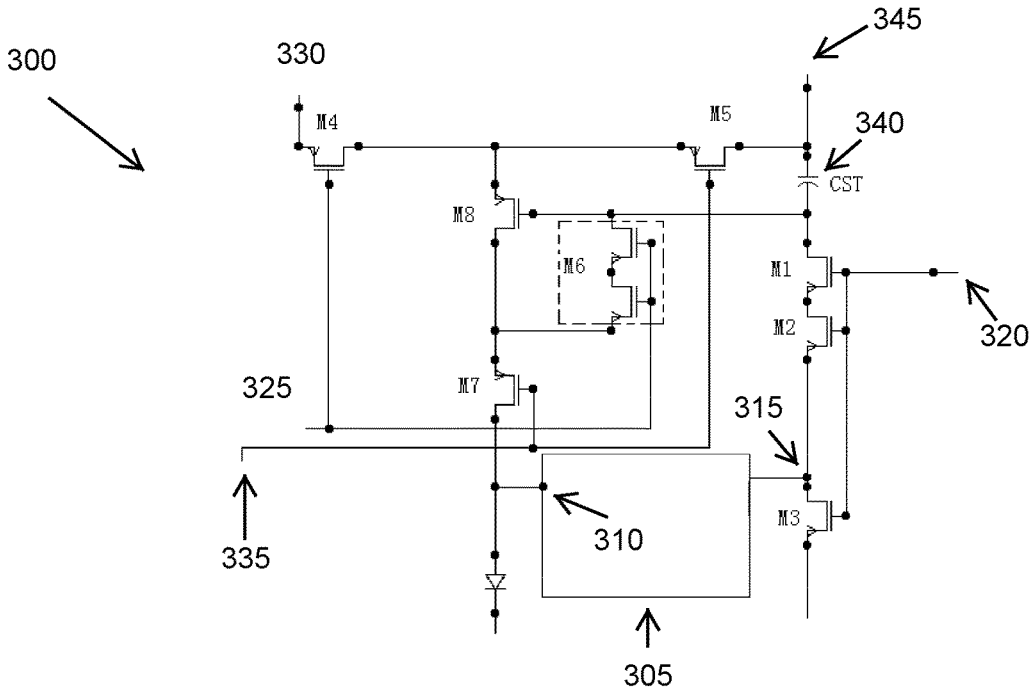
FIG. 3 is a connection diagram of a compensation circuit of the invention.

FIG. 3 illustrates a compensation circuit 300 that can be applied to an AMOLED device comprising a plurality of pixel units. Each pixel unit includes at least one light emitter and the followings:

an anode initialization signal interface 305, including an anode initialization input terminal 310 and an anode initialization output terminal 315. The anode initialization input terminal 310 is formed by an anode initialization output end of a previous pixel unit, said anode initialization input terminal 310 is configured to connect to an anode of said light emitter of the pixel unit The circuit 300 is further configured to, via the anode initialization input terminal 310, initialize the anode of the light emitter upon detecting of a predetermined signal, and change the operating state of the compensation circuit 300 to an anode initialization state;

a CST initialization terminal 320, configured to control the operating state of a first switch, connected to a control terminal of the first control switch, an input end of said first control switch connecting to a first reference potential, an output end of the first control switch connecting to a negative terminal of a capacitor, a positive terminal of the capacitor connecting to a high level (as defined herein, a high level means a power source that provides a high-level voltage, this high level of voltage depends on the timing sequence of the circuitry. For example the peak of a wave in the timing sequence represents a high level while the trough of the wave represents a low level) 345, the compensation circuit 300 being in a CST initialization state when the first switch is in conducting state;

a data control terminal 325, configured to control the operating state of a second switch, connecting to a control terminal of a second switch, an input end of the second switch being connected to a data input terminal 330, and an output end of the second switch being connected to a negative terminal of the capacitor, said capacitor storing signals output from the data input terminal 330 when the second control switch is in a conducting state, so that said compensation circuit 300 operates in a data inputting state;

a signal control terminal 335, outputting a predetermined signal after the pixel unit goes through the anode initialization state, the CST initialization state and the data inputting state, so that the light emitter operates in a light-emitting state.

Figure 4:
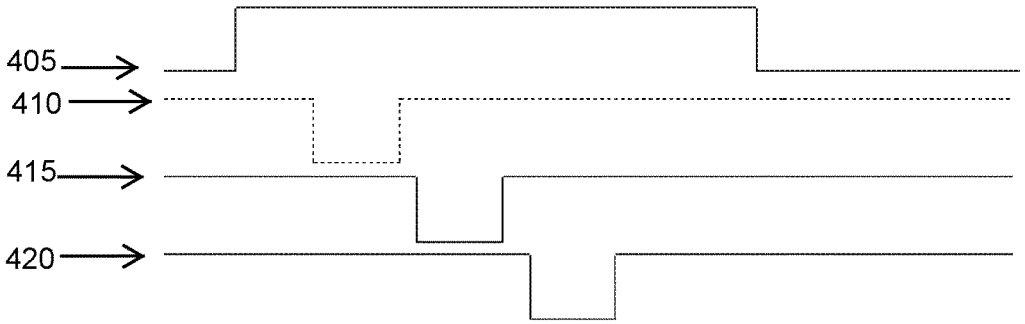
FIG. 4 is a diagram of the operating status of a compensation circuit of the invention.

The operating principles of the invention are illustrated as follows. As shown in FIG. 4, the traditional compensation circuit operates with four states, which are the CST initialization state 415, the data inputting state 420, the anode initialization state 410, and the light-emitting state 405. In the present inventive subject matter, an embodiment is provided, which comprises three pixel units (respectively defined as a first pixel unit, a second pixel unit, and a third pixel unit, wherein the first pixel unit corresponds to a previous pixel unit of the invention, and the third pixel unit corresponds to a next pixel unit of the invention), said anode initialization input terminal of the second pixel unit is formed by the anode initialization output terminal of the first pixel unit. Similarly, said anode initialization output terminal of the second pixel unit forms the anode initialization input terminal of the third pixel unit; when the output of the CST initialization terminal of the first pixel unit is at a low voltage level, the first switch of the first pixel unit is switched on, the second switch is switched off, the voltage output from the first reference potential refreshes the anode of the light emitter of the second pixel unit through the first switch, so that the second pixel unit is in the anode initialization state 410. According to the inventive subject matter, there is no need to separately set up an anode initialization signal line because the anode initialization input terminal is connected to the anode initialization output terminal of the previous pixel unit, This feature allows the number of signal lines to be reduced from four (4) to three (3), thereby achieving HPPI product design principle. And the signal control lines reduce the space occupied by cross-wire during the connection process, which is beneficial to designing products with slim edges. The inventive subject matter also changes the order the compensation circuit advances through the four operating states 405-420. Under this approach, the compensation circuit migrates from the anode initialization state 410 to the CST initialization state 415, then to the data inputting state 420, and then to the light-emitting state 405.

As a further preferred embodiment, in said compensation circuit, the anode initialization output end is used to form an anode initialization input end of a next pixel unit.

As a further preferred embodiment, with continued reference to FIG. 3, in said compensation circuit, said first switch comprises a first switch control tube M1, a second switch control tube M2 and a third switch control tube M3, a control terminal of the first switch control tube M1, a control terminal of the second switch control tube M2 and a control terminal of the third switch control tube M3 are connected to the CST initialization port, an output end of the first switch control tube M1 connects the negative terminal of the capacitor CST; an input end of the first switch control tube M1 connects an output end of the second switch control tube M2, an input end of the second switch control tube M2 connects an output end of the third switch control tube M3, an input end of the third switch control tube M3 connects the first reference potential, the output end of the third switch control tube M3 forms the anode initialization output end.

As a further preferred embodiment, in said compensation circuit 300, said second switch includes a fourth switch control tube M4, a fifth switch control tube M5, a sixth switch control tube M6, a seventh switch control tube M7 and an eighth switch control tube M8, both a control terminal of the fourth switch control tube M4 and a sixth switch control tube M6 connect the data control terminal 325, an input end of the fourth switch control tube M4 connects the data input terminal 330, an output end of the fourth switch control tube M4 connects an input end of the fifth switch control tube M5 and an input end of the eighth switch control tube M8, an output end of the fifth switch control tube M5 connects the high level 345, a control terminal of the seventh switch control tube M7 and a control terminal of the fifth switch control tube M5 connect to the signal control terminal 335, an input end of the seventh switch control tube M7 connects an output end of an eighth switch control tube M8 and an input end of the sixth switch control tube M6, an output end of the seventh switch control tube M7 connects the anode of the light emitter, a control terminal of the eighth switch control tube M8 respectively connects an output end of the sixth switch control tube M6 and the negative terminal of the capacitor CST.

When a low level of power is supplied to the CST initialization terminal 320, and the signal control terminal 335 and the data control terminal 325 both output high level of power, the first switch control tube M1, the second switch control tube M2, and the third switch control tube M3 would switch on, and the remaining switch control tubes would switch off, the capacitor CST would be in a charging state, causing the voltage of the negative terminal of the capacitor CST 340 to be substantially similar to the voltage of the first reference potential voltage, and the compensation circuit 300 to operate in the CST initialization state 415.

When the signal control terminal 335 outputs a high level of power and the data control terminal 325 outputs a low level of power, the fourth switch control tube M4, the eighth switch control tube M8 and the sixth switch control tube M6 would switch on and the remaining switch control tubes would switch off, causing the data input terminal 330 to connect to the negative end of the capacitor 340, and the compensation circuit 300 to be in the data inputting state 420.

When the signal control terminal 335 outputs a low level of power and the data control terminal 325 outputs a high level of power, the fifth switch control tube M5, the eighth switch control tube M8 and the seventh switch control tube M7 switch on, causing the light emitter to be in the light-emitting state 405.

As a further preferred embodiment, in said compensation circuit 300, the first switch and the second switch are PMOS transistors. In another embodiment, the first switch and the second switch may be formed by NMOS transistors, or other switches having a switch control.

As a further preferred embodiment, said predetermined signal has a low level of power. However, the predetermined signal can also be adjusted to a high level of power according to the actual situation in some embodiments, but the features of other circuit elements need to be replaced or adjusted accordingly in order to achieve the object of the invention.

Figure 5:
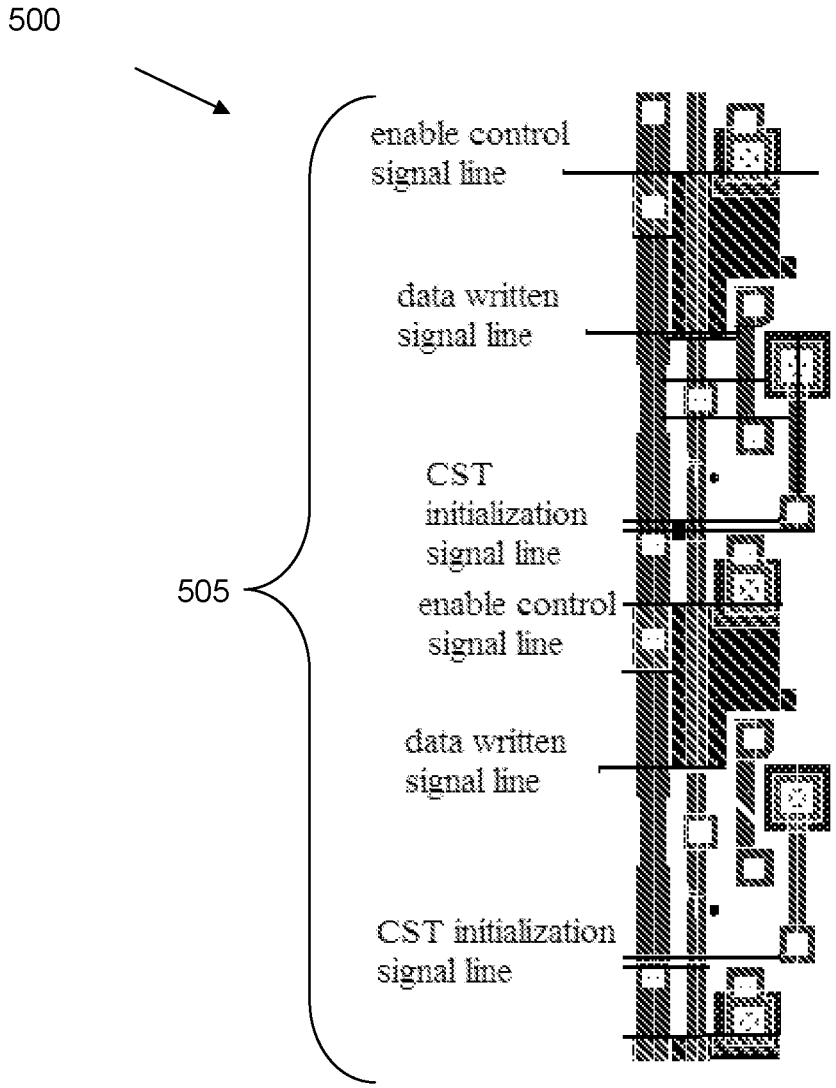
FIG. 5 is a diagram of the circuit architecture of an AMOLED structure of the invention.

As shown in FIG. 5, an AMOLED structure 500, which includes a pixel array 505 having a plurality of pixel units arranged in a matrix;

Each of said pixel units are provided with CST initialization signal line, a data inputting signal line, an enabling signal line and an anode initialization signal line;

Wherein the anode initialization signal lines of the pixel units of the N-th row are connected to the input ends of the CST initialization signal lines of the pixel units of the N+1-th row, said N is a positive integer.

An AMOLED structure, its working principle is similar to the working principle of the above compensation circuit, and will not be described again.

As a further preferred embodiment, the above-described AMOLED structure, wherein the pixel units are disposed within said AMOLED structure in a vertical manner. The vertical connection mode is conducive to line architecture.

A display device comprises any one of the above-described AMOLED structure.

The foregoing is only the preferred embodiments of the invention, not thus limiting embodiments and scope of the invention, those skilled in the art should be able to realize that the schemes obtained from the content of specification and figures of the invention are within the scope of the invention.

What is claimed is:

1. A compensation circuit configured to work with active-matrix organic light emitting diode (AMOLED) devices, the compensation circuits comprising at least a first pixel unit, a second pixel unit, and a third pixel unit, wherein each of the first, second, and third pixel units comprises:

at least one light emitter;

a first switch and a second switch;

an anode initialization signal interface comprising an anode initialization input terminal and an anode initialization output terminal, wherein the anode initialization input terminal of the second pixel unit is formed by the anode initialization output terminal of the first pixel unit, wherein the anode initialization input terminal of each pixel unit is coupled with an anode of said light emitter of the pixel unit wherein the compensation circuit is configured to operate in an anode initialization operating state by initializing the anode of the light emitter via the anode initialization input terminal upon detecting a predetermined signal;

a CST initialization terminal coupled with a control terminal of the first switch to control an operating state of the first switch, wherein an input terminal of said first switch is coupled with a first reference potential terminal of the compensation circuit, wherein an output terminal of the first switch is coupled with a negative terminal of a capacitor, wherein a positive terminal of the capacitor is coupled with a high level of power source, wherein the compensation circuit is configured to change its operating state to a CST initialization state when the first switch is in a conducting state;

a data control terminal coupled with a control terminal of the second switch to control the operating state of the second switch, wherein an input terminal of the second switch is coupled with an inputting terminal of the compensation circuit, and an output terminal of the second switch is coupled with a negative terminal of the capacitor, wherein said capacitor stores signals output from the data inputting terminal when the second switch is in a conducting state, wherein the compensation circuit is configured to operate in a data inputting state when the second switch is in the conducting state; and a signal control terminal configured to output the predetermined signal after the second pixel unit goes through the anode initialization state, the CST initialization state and the data inputting state, to cause the light emitter to operate in a light-emitting state.

2. The compensation circuit of claim 1, wherein the anode initialization output terminal of the second pixel unit is used to form the anode initialization input terminal of the third pixel unit.

3. The compensation circuit of claim 1, wherein the first switch comprises a first switch control tube, a second switch control tube and a third switch control tube, wherein a control terminal of the first switch control tube, a control terminal of the second switch control tube, and a control terminal of the third switch control tube are coupled with the CST initialization terminal.

4. The compensation circuit of claim 3, wherein an output terminal of the first switch control tube is coupled with the negative terminal of the capacitor.

5. The compensation circuit of claim 3, wherein an input terminal of the first switch control tube is coupled with an output terminal of the second switch control tube.

6. The compensation circuit of claim 3, wherein an input terminal of the second switch control tube is coupled with an output terminal of the third switch control tube.

7. The compensation circuit of claim 3, wherein an input terminal of the third switch control tube is coupled with the first reference potential terminal of the compensation circuit.

8. The compensation circuit of claim 3, wherein the output terminal of the third switch control tube forms the anode initialization output terminal of the compensation circuit.

9. The compensation circuit of claim 1, wherein said second switch includes a fourth switch control tube, a fifth switch control tube, a sixth switch control tube, a seventh switch control tube, and an eighth switch control tube.

10. The compensation circuit of claim 9, wherein both a control terminal of the fourth switch control tube and a control terminal of the sixth switch control tube is coupled with the data control terminal.

11. The compensation circuit of claim 9, wherein an input terminal of the fourth switch control tube is coupled with the data inputting terminal.

12. The compensation circuit of claim 9, wherein an output terminal of the fourth switch control tube is coupled with an input terminal of the fifth switch control tube and an input terminal of the eighth switch control tube.

13. The compensation circuit of claim 9, wherein an output terminal of the fifth switch control tube is coupled with the high level of voltage source.

14. The compensation circuit of claim 9, wherein a control terminal of the seventh switch control tube and a control terminal of the fifth switch control tube are coupled with the signal control terminal.

15. The compensation circuit of claim 9, wherein an input terminal of the seventh switch control tube is coupled with an output terminal of an eighth switch control tube and an input terminal of the sixth switch control tube.

16. The compensation circuit of claim 9, wherein an output terminal of the seventh switch control tube is coupled with the anode of the light emitter, and wherein a control terminal of the eighth switch control tube is coupled with an output terminal of the sixth switch control tube and the negative terminal of the capacitor.

17. The compensation circuit of claim 1, wherein said first switch is a PMOS transistor.

18. The compensation circuit of claim 1, wherein said second switch is a PMOS transistor.

19. The compensation circuit of claim 1, wherein said predetermined signal has a low voltage level.

20. An AMOLED structure comprising a pixel array having a plurality of pixel units arranged in an array comprising rows and columns, and a compensation circuit configured to work with the AMOLED structure; the compensation circuits comprising at least a first pixel unit, a second pixel unit, and a third pixel unit, wherein each of the first, second, and third pixel units comprises:

at least one light emitter;

a first switch and a second switch;

an anode initialization signal interface comprising an anode initialization input terminal and an anode initialization output terminal, wherein the anode initialization input terminal of the second pixel unit is formed by the anode initialization output terminal of the first pixel unit, wherein the anode initialization input terminal of each pixel unit is coupled with an anode of said light emitter of the pixel unit wherein the compensation circuit is configured to operate in an anode initialization operating state by initializing the anode of the light emitter via the anode initialization input terminal upon detecting a predetermined signal;

a CST initialization terminal coupled with a control terminal of the first switch to control an operating state of the first switch, wherein an input terminal of said first switch is coupled with a first reference potential terminal of the compensation circuit, wherein an output terminal of the first switch is coupled with a negative terminal of a capacitor, wherein a positive terminal of the capacitor is coupled with a high level of power source, wherein the compensation circuit is configured to change its operating state to a CST initialization state when the first switch is in a conducting state;

a data control terminal coupled with a control terminal of the second switch to control the operating state of the second switch, wherein an input terminal of the second switch is coupled with an inputting terminal of the compensation circuit, and an output terminal of the second switch is coupled with a negative terminal of the capacitor, wherein said capacitor stores signals output from the data inputting terminal when the second switch is in a conducting state, wherein the compensation circuit is configured to operate in a data inputting state when the second switch is in the conducting state; and a signal control terminal configured to output the predetermined signal after the second pixel unit goes through the anode initialization state, the CST initialization state and the data inputting state, to cause the light emitter to operate in a light-emitting state;

wherein, each of said pixel units also comprises a CST initialization signal line, a data inputting signal line, an enabling signal line, and an anode initialization signal line;

wherein the anode initialization signal lines of the pixel units of an N-th row are coupled with the input ends of the CST initialization signal lines of the pixel units of the N+1-th row, wherein said N is a positive integer.

21. The AMOLED structure of claim 20, wherein each of the pixel units is configured on said AMOLED structure in a vertical manner.

22. A display device, comprising an AMOLED structure having:

a pixel array comprising a plurality of pixel units arranged in an array having rows and columns;

and a compensation circuit configured to work with the AMOLED structure; the compensation circuits comprising at least a first pixel unit, a second pixel unit, and a third pixel unit, wherein each of the first, second, and third pixel units comprises:

at least one light emitter;

a first switch and a second switch;

an anode initialization signal interface comprising an anode initialization input terminal and an anode initialization output terminal, wherein the anode initialization input terminal of the second pixel unit is formed by the anode initialization output terminal of the first pixel unit, wherein the anode initialization input terminal of each pixel unit is coupled with an anode of said light emitter of the pixel unit wherein the compensation circuit is configured to operate in an anode initialization operating state by initializing the anode of the light emitter via the anode initialization input terminal upon detecting a predetermined signal;

a CST initialization terminal coupled with a control terminal of the first switch to control an operating state of the first switch, wherein an input terminal of said first switch is coupled with a first reference potential terminal of the compensation circuit, wherein an output terminal of the first switch is coupled with a negative terminal of a capacitor, wherein a positive terminal of the capacitor is coupled with a high level of power source, wherein the compensation circuit is configured to change its operating state to a CST initialization state when the first switch is in a conducting state;

a data control terminal coupled with a control terminal of the second switch to control the operating state of the second switch, wherein an input terminal of the second switch is coupled with an inputting terminal of the compensation circuit, and an output terminal of the second switch is coupled with a negative terminal of the capacitor, wherein said capacitor stores signals output from the data inputting terminal when the second switch is in a conducting state, wherein the compensation circuit is configured to operate in a data inputting state when the second switch is in the conducting state; and a signal control terminal configured to output the predetermined signal after the second pixel unit goes through the anode initialization state, the CST initialization state and the data inputting state, to cause the light emitter to operate in a light-emitting state;

wherein each of said pixel units are provided with a CST initialization signal line, a data inputting signal line, an enabling signal line, and an anode initialization signal line;

wherein the anode initialization signal lines of the pixel units of an N-th row are coupled with the input ends of the CST initialization signal lines of the pixel units of the N+1-th row, said N is a positive integer.

23. The display device of claim 22, wherein each of the pixel units is disposed within said AMOLED structure in a vertical manner.

* * * * *